United States Patent [19]

Smolarek

[11] 4,436,146

[45] Mar. 13, 1984

[54] SHELL AND TUBE HEAT EXCHANGER

[75] Inventor: James Smolarek, Blasdell, N.Y.

[73] Assignee: Union Carbide Corporation, Danbury, Conn.

[21] Appl. No.: 265,681

[22] Filed: May 20, 1981

[51] Int. Cl.[3] ..... F28D 7/02

[52] U.S. Cl. ..... 165/111; 165/114

[58] Field of Search ..... 165/111, 159, 110, 114

[56] References Cited

U.S. PATENT DOCUMENTS

| | | | |
|---|---|---|---|
| 1,562,682 | 11/1925 | Braun | 165/110 |
| 2,254,070 | 7/1938 | Jacocks | 257/28 |
| 2,434,519 | 1/1948 | Raskin | 165/110 |
| 4,114,684 | 9/1978 | Jenis et al. | 165/162 |
| 4,191,246 | 3/1980 | Cassell | 165/162 |
| 4,256,783 | 3/1981 | Takada et al. | 165/162 |

*Primary Examiner*—William R. Cline
*Assistant Examiner*—John F. McNally
*Attorney, Agent, or Firm*—Stanley Ktorides

[57] ABSTRACT

A shell and tube heat exchanger module which can be easily combined with other such modules to effect a close packed arrangement and which allows condensation of a vapor stream containing a non-condensible fraction without allowing a vapor buildup. The heat exchanger is particularly suitable as a main condenser in a cryogenic air separation process.

13 Claims, 6 Drawing Figures

SHELL AND TUBE HEAT EXCHANGER

BACKGROUND OF THE INVENTION

The present invention relates to an improved shell and tube heat exchanger. In one aspect, the present invention pertains to a shell and tube heat exchanger useful in condensing a vapor stream containing some fraction of a non-condensible constituent. In another aspect, the present invention pertains to a shell and tube heat exchanger which is readily adaptable to a close-packed modular construction and which is able to endure the high thermally-induced stresses caused by changing temperature conditions.

The present invention is particularly well-suited for use the main condenser of an air separation plant double column, wherein the condensing nitrogen stream contains a small fraction of inert gases such as helium and neon which do not condense at the conditions prevailing in the main condenser. In this specific application, the main condenser provides two primary functions: it condenses the nitrogen separated in the lower column for its subsequent use as a reflux liquid in both the lower and upper columns, and it boils the liquid oxygen collected in the kettle of the upper column.

It is known in the art that the proper design of the main condenser is critical to achieve an energy efficient separation of air in a double column arrangement. An increase in the temperature difference between the shell and tube sides of the heat exchanger of 1.0° K. represents about a 6 psi increase in the required head pressure for the entire air separation plant. Even more important, as readily recognized by one skilled in this technology, the design and operation of the main condenser is critical if one is to minimize the safety hazards normally associated with boiling liquid oxygen. As oxygen is evaporated to dryness, trace quantities of soluble hydrocarbons, which are normally present in the compressed feed air stream of the separation facility, are concentrated within the liquid. Eventually a combustible mixture may be formed which can explode violently. The design of the main condenser, therefore, must prevent this equilibrium boiling as well as the formation of localized pockets where boiling to dryness may occur.

A conventional main condenser in use today employs an open-ended vertical arrangement of boiling passages for the liquid oxygen. The boiling passages are partially submerged in a pool of liquid oxygen and the heat of vaporization is supplied by nitrogen condensing at a higher pressure (typically 110 psig) in heat transfer relationship with the boiling passages. The exchanger is designed such that the rate of vaporization within the passages is sufficient to entrain liquid with the rising vapor. With this open-ended design approach, the condenser can operate as a natural recirculation evaporator (thermo syphon reboiler), wherein the liquid entrained with the rising vapor is subsequently returned to the liquid pool and then to the boiling passages by gravity. As a result, not only is a constant supply of liquid provided to the boiling passages, but the plugging of individual passages and the concentration of hydrocarbons in the liquid are prevented by the flushing effect of the recirculating liquid.

Generally, plate type heat exchangers are employed for the main condenser in an air separation facility rather than shell and tube type exchangers because the plate type design is not plagued with the type of thermally induced stresses that one finds in a shell and tube exchanger, and the boiling passages are wide enough to eliminate the potential safety hazard involved with boiling liquid oxygen.

It is desirable to employ a shell and tube type heat exchanger in this application in order to increase the boiling heat transfer coefficient. However, with conventional shell and tube-type heat exchangers, excessive thermally imposed stresses may be created during transitional operating conditions, such as occur at start-up or shut-down. These stresses are caused by the temperature difference created between the tubes and the cylindrical shell during such transitional operating conditions. The tubes are thin walled members relative to the shell and therefore, their temperature will change much more rapidly in response to changing conditions than will the temperature of the shell. Accordingly, at any time when the temperature within the main condenser is changing, a temperature difference will be created between the tubes and the shell. Because the tubes are axially constrained by their rigid connection to the tube sheet, which in turn is rigidly connected to the cylindrical shell, the tubes are restrained from undergoing the thermal contraction or expansion coincident with their temperature. Instead, the tubes are restricted to the expansion or contraction of the shell, which because of its higher thermal inertia will be at a much lower rate than that of the tubes. As a result, depending upon whether the tubes are expanding or contracting, a large compressive or tensile load is applied to the tubes and the tube-type sheet joints. This load can be large enough to cause a failure of the joint or of an individual tube unless the temperature difference between the tube and the shell is adequately controlled. As a result, elaborate procedures and instrumentation are required for cool-down (start-up) and thawing (shut-down) of the main condenser to prevent a premature failure of the equipment.

Heat exchange prior art illustrates a possible solution to the above problem. In U.S. Pat. No. 2,254,070-Jacocks, for example, an expansion member is used as part of the cylindrical shell; while in U.S. Pat. No. 2,468,903-Villiger, an expansion member is used to join one of the spaced tube sheets to the cylindrical shell. Jacocks is particularly noteworthy in that it also illustrates the additional concept of employing a modular heat exchanger approach, wherein a single exchanger is fabricated from a number of individual heat exchanger components. This latter concept is especially important because it allows one to use small, commercially available expansion members in the fabrication of the individual modules rather than having to independently fabricate a large, non-commercially avilable expansion member which would obviously entail a significantly higher production expense.

One problem which has plagued main condensers used in air separation facilities is the accumulation of non-condensible constituents within the heat exchanger. When the vapor to be condensed contains a fraction which will require a significantly lower temperature for condensation, this fraction will build up on the condensing side of the heat exchanger and increase the temperature difference between the exchanging fluids. This buildup will increase until either the corresponding solubility of the non-condensibles in the condensed liquid allows their removal with the liquid at a rate equal to the rate at which the non-condensibles are introduced into the exchanger, or, in the limit, until the heat exchanger becomes vapor bound. In either case, the efficiency of the heat exchanger is drastically affected.

A problem associated with modular heat exchangers is the packing efficiency or the proximity with which the modules can be placed relative to each other. The packing efficiency of the modular assembly is a very important aspect of a main condenser design, since this determines the overall diameter of the main condenser needed to supply the necessary heat transfer area. The diameter of the main condenser is an important consideration for several reasons. First of all, transportation laws and regulations impose an upper limit on the diameter of equipment that can be shipped in interstate commerce. Secondly, in the most preferred configuration of an air separation facility, the main condenser is positioned between the stacked lower and upper columns. As a result, the diameter of the main condenser cannot be markedly disproportionate to their respective diameters. Thirdly, the surface area of the main condenser varies as a square of its diameter. Since heat leak into the condenser is proportional to its surface area, minimizing the diameter of the condenser is a key factor for minimizing heat leak.

Accordingly, it is an object of the present invention to provide an open-ended shell and tube heat exchanger which is capable of withstanding large thermal gradients between the shell and the heat exchange tubes.

It is another object of this invention to provide a heat exchanger which is capable of operating safely in a pool of liquid oxygen containing trace amounts of soluble hydrocarbons.

It is a further object of this invention to provide a heat exchanger which is capable of operating in an efficient manner when condensing a vapor stream containing a portion of non-condensible gas.

It is still another object of this invention to provide a modular heat exchanger capable of very high thermal performance while occupying a minimum of space.

SUMMARY OF THE INVENTION

The above and other objects which will become apparent to one skilled in the art are achieved by:

An open-ended shell and tube heat exchanger for use in a vertical position comprising:

(a) a longitudinal shell, (b) a pair of spaced tube sheets attached near their periphery to the upper and lower ends of the shell so as to define an enclosed space, (c) baffle means positioned proximate to the lower tube sheet extending across and attached to the longitudinal shell so as to divide the enclosed space into a larger condensation chamber and a smaller vapor-liquid separation chamber, said baffle means comprising a plurality of first openings and a plurality of second openings larger than said first openings, (d) a plurality of heat transfer tubes extending through the enclosed space having their opposite ends attached to each tube sheet, each tube extending through a first or second opening and adapted to have a first heat exchange medium flow therethrough, (e) a first conduit communicating with said condensation chamber, (f) means for distributing the vapor substantially throughout the condensation chamber, (g) a second conduit communicating with the vapor-liquid separation chamber, and (h) means for removing vapor collected in the vapor-liquid separation chamber.

The term, open-ended is used to mean that the plurality of heat transfer tubes are exposed directly to the fluid medium to be circulated therethrough without manifolding these tubes into a single outlet or a single inlet conduit.

The term, shell and tube heat exchanger, is used to mean a heat exchanger comprising a plurality of heat transfer tubes encased within a single larger shell such that one fluid can be circulated through the tubes while another fluid can be circulated through the volume surrounding the tubes enclosed by the shell.

As used herein, the term "column" refers to a distillation column, i.e., a contacting column wherein liquid and vapor phases are countercurrently and adiabatically contacted to effect separation of a fluid mixture, as for example, by contacting of the vapor and liquid phases on a series of vertically spaced-apart trays or plates mounted within the column, or alternatively, on packing elements with which the column is filled. For an expanded discussion of the foregoing, see the Chemical Engineers' Handbook, Fifth Edition, edited by R. H. Perry and C. H. Chilton, McGraw-Hill Book Company, New York, Section 13, "Distillation" B. D. Smith et al, page 13–3, *The Continuous Distillation Process.* A common system for separating air employs a higher pressure distillation column having its upper end in heat exchange relation with the lower end of a lower pressure distillation column. Cold compressed air is separated into oxygen-rich and nitrogen-rich liquids in the higher-pressure column and these liquids are transferred to the lower-pressure column for separation into nitrogen and oxygen-rich fractions. Examples of this double-distillation column system appear in Ruheman's "The Separation of Gases", Oxford University Press, 1949.

DESCRIPTION OF THE INVENTION

Figure 1:
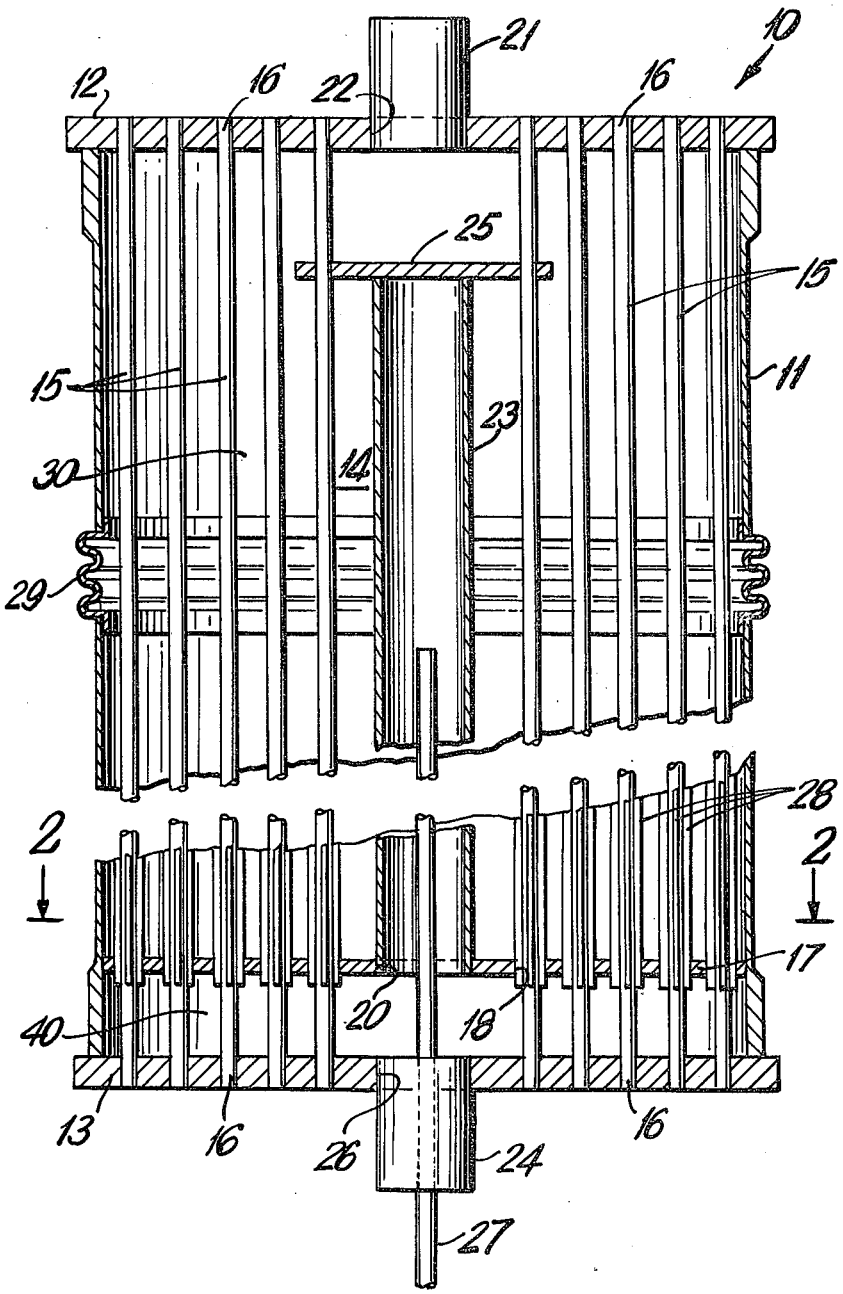
FIG. 1 illustrates an enlarged, vertical, sectional view of a shell and a tube heat exchanger constructed in accordance with a preferred embodiment of the present invention.
Figure 2:
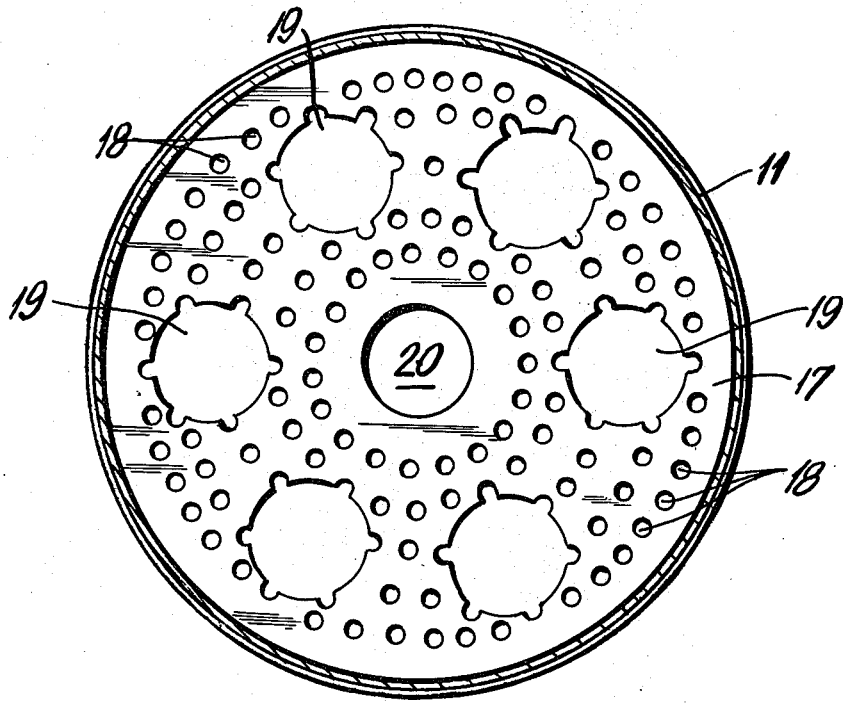
FIG. 2 is a cross-sectional view of the heat exchanger illustrated in FIG. 1 taken along line 2—2.
Figure 3:
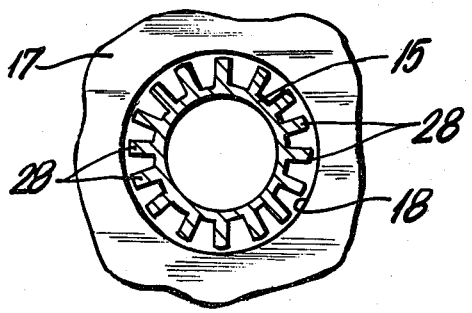
FIG. 3 illustrates an enlarged sectional view of a preferred single heat exchanger tube showing the clearance between the tube and baffle plate.

The heat exchanger of this invention in general, and a preferred embodiment in particular, is first described with references to FIGS. 1, 2 and 3. The heat exchanger 10 consists of a shell 11 bounded on its opposite ends by spaced tube sheets 12 and 13. Preferably, shell 11 is cylindrical. The tube sheets are secured near their peripheral edges to the shell so as to form an enclosed space 14. A plurality of heat transfer tubes 15 extend through the enclosed space and are attached at their opposite ends 16 to the tube sheets 12 and 13. The tubes are connected to the tube sheet so that a first heat transfer fluid may be passed through the tubes. Heat is transferred to the fluid within the tubes from a condensible vapor on the shell side of the heat exchanger 10 in the enclosed space 14. This condensible vapor is introduced into the enclosed space 14 through an inlet conduit 21 located at the top of the heat exchanger 10. In this preferred embodiment, the conduit 21 is coaxially positioned with the tubes 15 in the center opening 22 of the tube sheet 12 and a distribution baffle 25 is positioned a short distance in front of the inlet conduit so as to uniformly distribute the inflowing condensible vapor throughout the enclosed space 14. The diameter of the conduit 21 fixes the volume of the area within the heat exchanger that cannot be provided with heat transfer tubes. In this preferred embodiment, an enlarged tube 23 occupies this volume, thereby eliminating a flow path for the shell-side fluid to short circuit the heat transfer area.

The enclosed space 14 is functionally subdivided by a baffle means 17 into two separate compartments: a condensation chamber 30 and a vapor-liquid separation chamber 40. In this preferred embodiment, the baffle means consists of a unitary plate 17 horizontally positioned proximate to the tube sheet at the outlet end of the heat exchanger and attached at its periphery to the cylindrical shell 11. However, the baffle means need not be a unitary plate and can be made up of a number of independent baffles. Further, it need not be horizontally positioned; for example, it can be slightly angled. The baffle plate 17 is provided with a plurality of smaller openings 18 through which the plurality of tubes extend. Preferably, the openings are of a sufficient size to allow the liquid flowing down along the tubes to flow into the vapor-liquid separation chamber. However, the openings are sufficiently small so that they can be sealed by the liquid and thereby prevent the passage of any appreciable quantity of uncondensed vapor therethrough. However, if desired, the smaller openings may be of a size so as to allow passage of only the tube therethrough; there need not be a space between the side of the tube and the baffle plate. The baffle plate 17 is also provided with a number of larger openings 19 through which the uncondensed vapor remaining in the condensation chamber is allowed to pass into the vapor-liquid separation chamber. Some of the tubes pass through the larger openings instead of the smaller openings. The heat transfer tubes are generally uniformly distributed through the baffle means and the only area where the tubes are not positioned is the center area occupied by the collection chamber for the non-condensible gases. However, every opening need not have a tube extending through it.

The actual construction of the baffle plate 17 is more clearly illustrated in FIG. 2. The purpose of the baffle plate is two-fold. First, the baffle plate acts as a flow area restriction causing a sudden or step increase in the flow velocity of the vapor flowing downwardly through the heat exchanger. In this way, passage of non-condensible vapors into the vapor-liquid separation chamber is ensured. Preferably, the baffle plate reduces the cross-sectional area available for the shell-side fluid flow by between about 10% and 50% relative to the cross-sectional area available for flow in the condensation chamber. In the most preferable main condenser application this flow area is restricted between 15% and 20%. The flow area is the cross-sectional area of condensation chamber minus the area of the tubes. The restriction in the flow area is the area of the solid portion of the baffle means. Secondly, the baffle plate functionally divides the heat exchanger module into the condensation chamber and the vapor-liquid separation chamber. In this way, an isolated portion of the module is created wherein non-condensable components might be collected and removed. It is important that the baffle means be positioned proximate to the tube sheet at the outlet end. The exact point of attachment and therefore the respective sizes of the condensation chamber and the separation chamber relative to the enclosed space will vary and will depend on factors such as the particular heat exchange fluids employed. However, the baffle means must be positioned close to the outlet end so as to allow condensation of substantially all of the condensable portion of the shell side heat transfer medium before the portion remaining as vapor impinges the baffle means. In this way, efficient heat exchange operation is attained.

In addition to the openings 18 and 19 in this embodiment, the baffle plate is also provided with a central opening 20 to which an enlarged tube 23 is attached. The tube 23 extends coaxially with the plurality of tubes and terminates at a sealed end within the condensation chamber 30. In this preferred embodiment, the end of the enlarged tube 23 is sealed by the distribution baffle 25. As noted above, tube 23 occupies the void volume created behind the conduit 21. In this design, tube 23 also functions as a collection space for the non-condensible vapor flowing into the vapor-liquid separation chamber.

An outlet conduit 24 for removing condensed liquid from the vapor-liquid separation chamber is also provided. In this preferred embodiment, the conduit 24 is attached to the tube sheet 12 at the central opening 26. A conduit 27 is then provided, which extends into the enclosed space and preferably communicates with the enlarged tube, for removing the non-condensable vapor collected within the enlarged tube. In this preferred embodiment, the conduit 27 extends into the enclosed space through the outlet conduit 24.

In operation of this heat exchanger, a condensable vapor containing a portion of non-condensable constituents, is introduced into the enclosed space 14 through the inlet conduit 21. The vapor flowing through conduit 21 impinges upon distribution baffle 25 and is forced to flow radially therefrom. Accordingly, the vapor is uniformly distributed throughout the plurality of tubes 15. The heat exchanger 10 is vertically oriented so that as liquid condenses from the vapor within the enclosed space 14, onto the tubes 15, it can flow by gravity along these tubes in the same direction of flow as the bulk vapor stream. To promote the condensation of the vapor, a heat transfer fluid is circulated through the plurality of tubes 15. In the main condenser application this circulation is induced by at least partially submerging the module in a pool of liquid oxygen. The system is then operated so that vaporization of the liquid oxygen is sufficient to entrain liquid with the vapor leaving the tubes.

The baffle plate 17 is positioned within the enclosed space 14 so that a condensation chamber is formed. The condensation chamber is sized so that essentially the entire condensable fraction of the entering vapor is condensed therein. Preferably, the condensation chamber occupies greater than 75%, most preferably from about 85 to 90%, of the heat exchanger volume with the remainder being the vapor-liquid separation chamber. As the vapor condenses within the condensation chamber, the liquid collects on the tubes and flows downwardly to the vapor-liquid separation chamber 40. Preferably, the tubes are provided with axial flutes 28 which are more clearly illustrated in FIG. 3. These flutes promote the condensing action, since surface tension forces reduce the liquid film thickness on the flutes. In addition to providing an extended heat transfer surface for condensation, the flutes also provide drainage channels between adjacent flutes, allowing the rapid removal of the condensed liquid from the tubes by gravity. The condensed liquid flows down along the tubes, passes through the openings 18 and 19 provided in the baffle plate 17 and is collected in the vapor-liquid separation chamber 40.

As the vapor passes through the condensation chamber 30, and liquid is progressively condensed out, the flow rate of the vapor begins to decrease within the condensation chamber. As the velocity of this vapor decreases, there is a tendency for the non-condensable constituents in the vapor, which progressively increase in concentration, to diffuse in the opposite direction of flow. If this non-condensable vapor is allowed to collect anywhere within the condensation chamber 30, the efficiency of the heat exchanger 10 would be significantly impaired. As a result, the baffle plate 17 is provided with a number of openings 19 through which this non-condensable vapor is allowed to pass into the vapor-liquid separation chamber. The volume of the vapor-liquid separation chamber is sized such that it can safely accommodate the flow of the condensed shell-side fluid into the outlet conduit 24 without blocking (flooding) the openings 19. The openings are distributed uniformly over baffle plate 17. Because the flow area provided through these openings is smaller than the cross-sectional area available for flow throughout the condensation chamber, the flow velocity of the non-condensable vapor is forced to increase at this point and the passage of the non-condensable vapor into the vapor-liquid separation chamber is ensured.

Once entering the vapor-liquid separation chamber, the non-condensable vapor can be effectively removed. In the broad practice of this invention, the condensed liquid and non-condensable vapor could be removed through the same passageway, followed by subsequent separation in a vapor-liquid separator. Because of the possibility that the condensed liquid may block this passageway, however, preventing the flow of the non-condensable vapor from the chamber 40, the arrangement in FIG. 1 is preferably employed. In this design the non-condensable vapor, once entering the vapor-liquid separation chamber, is drawn into the enlarged tube 23. Flow into the tube 23 is promoted by at least periodically removing the vapor collected within the tube 23 through the conduit 27. The interior of the tube 23 acts as a reflux liquid separator. The flow of the condensed shell-side fluid through the vapor-liquid separation chamber and into the outlet conduit 24 tends to generate a liquid spray in the vicinity of the conduit 24. A fraction of this liquid spray tends to be entrained into the tube 23 along with the non-condensable vapor. The withdrawal of the liquid with the non-condensable vapor represents an unwanted loss of refrigeration with this stream. As a result, the end of the conduit 27 is positioned at the point within the tube 23 where any liquid that has been entrained into the tube has already been separated out by gravity. Thus, it is possible to efficiently prevent the accumulation of non-condensable vapor within the condensation chamber which would otherwise tend to impair the overall efficiency of the heat exchanger.

As is further illustrated in FIG. 1, the shell 11 is provided with an expansion joint 29. As noted previously, this expansion joint helps to reduce the tensile or compressive loading between the tube sheets 12 and 13 and the tubes 15, as well as between the tube sheets 12 and 13 and the shell 11 arising from either the internal pressurization of the shell or the existence of a temperature gradient between the tube and shell which would tend to cause an unequal expansion or contraction therebetween.

Figure 4:
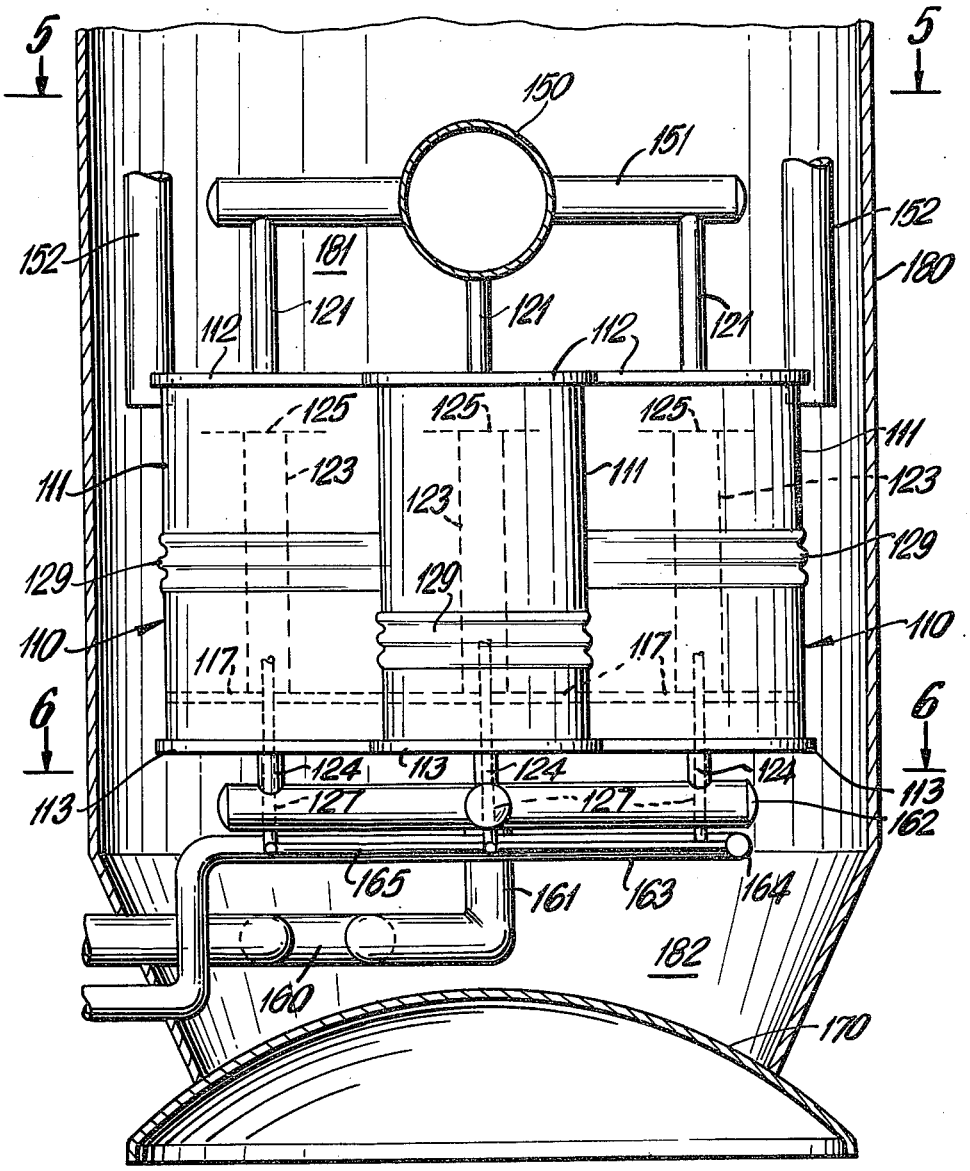
FIG. 4 is a vertical sectional view, with parts in elevation, of a main condenser employing a number of the heat exchange modules of FIG. 1.
Figure 5:
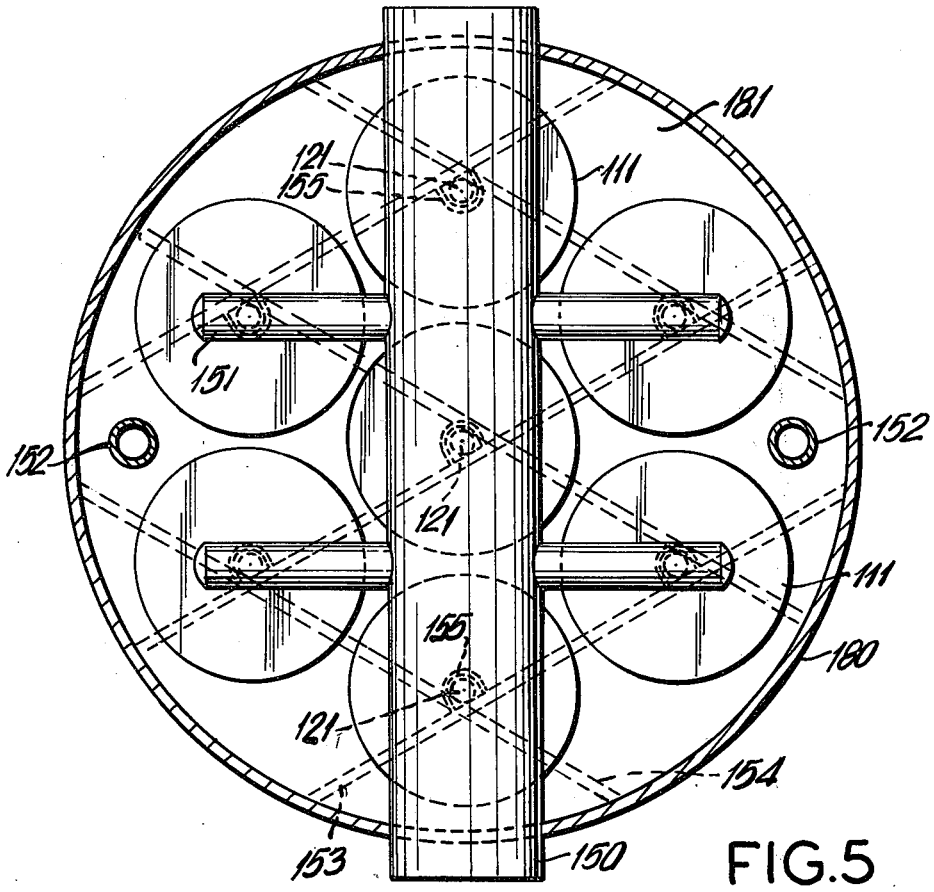
FIG. 5 is an overhead plan view, part in cross-section, of the FIG. 4 main condenser taken along line 5—5.
Figure 6:
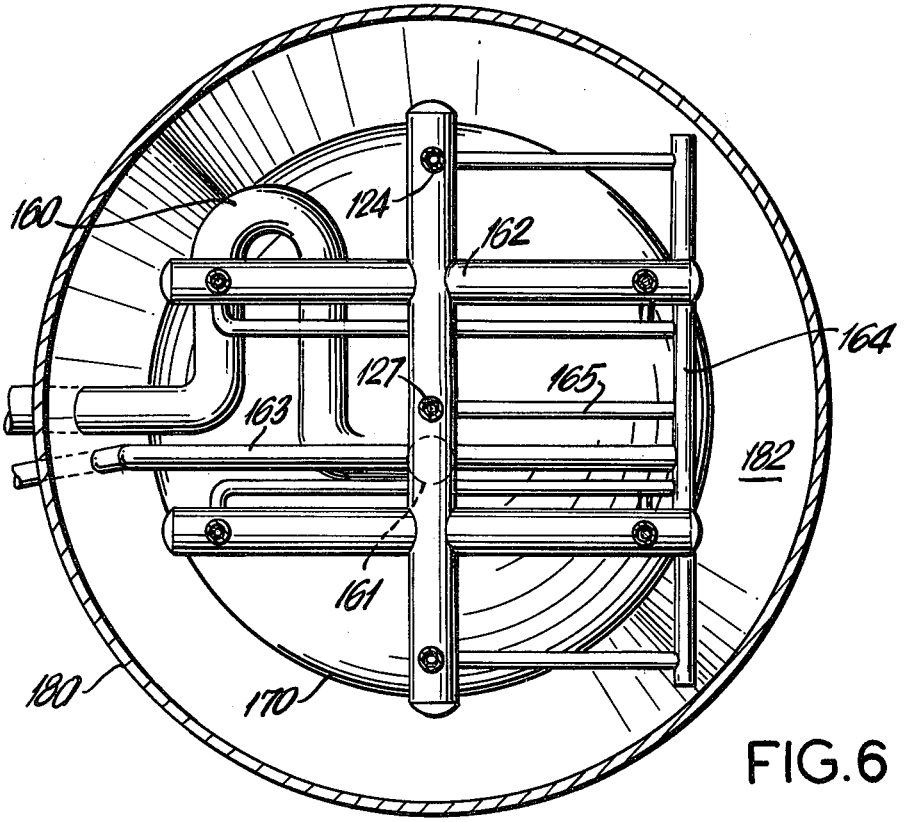
FIG. 6 is a cross-sectional view of the FIG. 4 main condenser taken along line 6—6 of FIG. 4.

Referring now to FIGS. 4, 5 and 6, a construction suitable for employing the heat exchanger of this invention in the main condenser of an air separation facility will be described. In this main condenser design, a number of the heat exchangers 110 are manifolded in parallel. The individual heat exchangers are supported from the main nitrogen vapor supply conduit 150. The supply conduit 150 is supported upon the column wall 180 and is attached to the lower column by means not shown. In this embodiment, some of the heat exchanger modules are suspended directly from the supply conduit 150 by their inlet conduits 121, while the other heat exchanger modules are suspended from the branch supply conduits 151.

By positioning the inlet conduits 121 at the center of the tube sheets of each heat exchanger module, two advantages over prior art open-ended shell and tube heat exchange modular construction are possible. Most importantly, it is possible to more closely space the heat exchanger modules. This feature is particularly important in the main condenser application where space conservation is important. Secondarily, with this construction each module may be independently supported by their shell side fluid inlet conduits thereby eliminating the need for a fabricated support structure. This construction allows the modules to move independent of their surroundings during periods of changing temperature conditions by allowing for the necessary piping flexibility to be incorporated in the smaller condensate piping under the modules. Such movement reduces the problem of equipment failure resulting from thermally imposed stresses.

As shown in FIG. 5, during shipment the inlet conduits 121 are restrained from transverse movement by means of clamps 155 which are attached to a superstructure constructed by crossing beams 153 and 154. These clamps and beams are removed during construction. At the lower end of the exchangers 110, the outlet conduits 124 are also manifolded in parallel into a branch discharge conduit assembly 162. The discharge assembly 162 is in turn connected to the condensate removal conduit 160 through the discharge conduit 161. The upper column shell 180 containing the described main condenser assembly is supported on the dome 170 of the lower column. Although not illustrated in FIG. 6, the outlet conduits 124 are also restrained by means of clamps and crossing beams during shipment.

In the operation of this condenser assembly, nitrogen vapor from the lower column is passed to the supply conduit 150 by means not shown. This vapor then flows into the individual heat exchangers 110 through the branched conduit 151 and the inlet conduits 121. The vapor entering each exchanger is forced to flow uniformly through each tube array by the various distribution baffles 125. The vapor passes downwardly through each heat exchanger and is condensed by heat exchange with liquid oxygen contained within the tubes. The liquid oxygen circulates through the tubes by natural convection.

The heat exchangers 110 are at least partially submerged within a pool of liquid oxygen. In the air separation application, it is necessary to maintain a reservoir of liquid oxygen surrounding the main condenser in order to minimize control related difficulties. Preferably, a surplus of liquid oxygen about two times the volume of liquid within the heat transfer tubes is provided. As an adjunct to the requirement that a surplus of liquid be preserved in the main condenser, it is also desirable to maintain the height of the oxygen pool at about the module height. Heights much above this level tend to reduce the overall heat exchange efficiency because of the higher hydrostatic head existing at the lower end of the tube bundle; heights significantly below this level tend to reduce the priming ratio, i.e. the quantity of liquid oxygen entrained at a given rate of vaporization. This tends to reduce the margin of safety in operating the main condenser. As noted, conditions are maintained within the main condenser such that the rate of vaporization within the tubes is sufficient to entrain liquid with the rising vapor. Gravity separates this liquid from the rising vapor in the space 181 above the exchangers 110, and this liquid returns to the liquid pool 182 surrounding the exchangers. Liquid oxygen from the lower most tray of the upper column is fed to the main condenser through conduits 152. This liquid is introduced in such a way that it will not impinge on the tops of the heat exchanger modules 110 so as to interfere with circulation of the entrained liquid (i.e. priming).

As described in connection with the FIGS. 1 through 3 embodiment, the condensed liquid nitrogen flows down the tubes in each of the exchanger modules 110 and passes through the baffle plate 117 into the various vapor-liquid separation chambers. The liquid then flows through the outlet conduits 124 into the discharge assembly 162. This condensed liquid collected within the discharge assembly 162 flows into the discharged conduit 161 and is removed from the main condenser through the serpentine condensate removal conduit 160. This liquid is subsequently used as reflux for both the upper and lower columns. The discharge piping is sized so that condensed nitrogen will drain by gravity from the condenser to the lower column.

Vapor not condensed within the exchanger modules 11O collects in each of the enlarged tubes 123. This vapor is removed from each exchanger module through the conduits 127. The vapor flows through the conduits 127 into the branch conduits 165 and then into the vent manifold 165. This gas is then removed from the main condenser through the vent conduit 163.

By the use of the modular open-ended shell and tube heat exchanger of this invention one can more efficiently condense a heat exchange vapor which contains a non-condensable fraction. Further, one can construct a more efficient heat exchanger arrangement than was heretofore possible with available modular open-ended shell and tube heat exchangers.

Although a preferred embodiment of this invention has been described in detail, it is readily appreciated that many other embodiments are contemplated as within the scope of this invention.

What is claimed is:

1. An open-ended, shell and tube heat exchanger for use in a vertical position comprising:

(a) a longitudinal shell, (b) a pair of spaced tube sheets attached near their periphery to the upper and lower ends of the shell so as to define an enclosed space, (c) baffle means positioned proximate to the lower tube sheet extending across and attached to the longitudinal shell so as to divide the enclosed space into a larger condensation chamber and a smaller vapor-liquid separation chamber, said baffle means comprising a plurality of first openings and a plurality of second openings larger than said first openings, (d) a plurality of heat transfer tubes extending through the enclosed space having their opposite ends attached to each tube sheet, each tube extending through a first or second opening and adapted to have a first heat exchange medium flow therethrough, (e) a first conduit for introducing vapor communicating with said condensation chamber, (f) means for distributing the vapor substantially throughout the condensation chamber, such that vapor and condensing liquid flow downwardly along substantially the entire length of said heat transfer tubes, (g) a second conduit having an opening communicating with the vapor-liquid separation chamber for removing condensed liquid, and (h) a third conduit having an opening communicating with the vapor-liquid separation chamber, for removing vapor, at a point above the opening of the second conduit.

2. The heat exchanger of claim 1 wherein said longitudinal shell is cylindrical in shape.

3. The heat exchanger of claim 1 wherein said heat transfer tubes are provided with axial flutes.

4. The heat exchanger of claim 1 wherein said first conduit is positioned in the center of the upper tube sheet.

5. The heat exchanger of claim 1 wherein said condensation chamber occupies more than 75% of the volume of said enclosed space.

6. The heat exchanger of claim 1 wherein said condensation chamber occupies from about 85 to 95% of the volume of said enclosed space.

7. The heat exchanger of claim 1 wherein the baffle means restricts the cross-sectional area of the condensation chamber available for vapor flow by from 1O to 50%.

8. The heat exchanger of claim 1 wherein the baffle means restricts the cross-sectional area of the condensation chamber available for vapor flow by from 15 to 20%.

9. The heat exchanger of claim 1 further comprising a tube positioned within the longitudinal shell co-axially with the plurality of heat transfer tubes, having one end attached to the baffle means in fluid flow communication with the vapor-liquid separation chamber and having the other end sealed and terminating in the condensation chamber so as to extend the vapor-liquid separation chamber to occupy the space within the tube.

10. The heat exchanger of claim 9 wherein said third conduit for removing vapor is positioned in fluid flow communication with said tube positioned within the longitudinal shell co-axially with the plurality of heat transfer tubes.

11. The heat exchanger of claim 1 wherein there is a space between the outside surface of the heat transfer tubes and the baffle means as the tubes pass through the first openings said space being sufficiently large so as to allow the liquid flowing down along the tubes to flow into the separation chamber but being sufficiently small so that they can be sealed by the downflowing liquid.

12. The heat exchanger of claim 1 wherein said baffle means is a unitary plate.

13. The heat exchanger of claim 1 wherein said baffle means is horizontally positioned

* * * * *